US008575906B2

(12) United States Patent
Morino

(10) Patent No.: US 8,575,906 B2
(45) Date of Patent: Nov. 5, 2013

(54) CONSTANT VOLTAGE REGULATOR

(75) Inventor: Koichi Morino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 300 days.

(21) Appl. No.: 13/179,907

(22) Filed: Jul. 11, 2011

(65) Prior Publication Data

US 2012/0013317 A1 Jan. 19, 2012

(30) Foreign Application Priority Data

Jul. 13, 2010 (JP) ..... 2010-158883

(51) Int. Cl.
*G05F 1/56* (2006.01)

(52) U.S. Cl.
USPC ..... 323/274; 323/313; 327/543

(58) Field of Classification Search
USPC ..... 323/207, 222, 266–269, 275, 279, 323/282–288, 311–314; 363/20, 21.02, 60, 363/72, 89, 95; 327/530, 513, 540, 534, 327/538, 435, 543
See application file for complete search history.

(56) References Cited

U.S. PATENT DOCUMENTS

| | | | | |
|---|---|---|---|---|
| 4,553,098 | A * | 11/1985 | Yoh et al. | 324/433 |
| 4,972,097 | A * | 11/1990 | You | 327/541 |
| 5,942,881 | A * | 8/1999 | Okada et al. | 323/277 |
| 6,528,975 | B2 * | 3/2003 | Sander | 323/281 |
| 6,683,765 | B2 * | 1/2004 | Kanamori | 361/18 |
| 7,394,307 | B2 | 7/2008 | Negoro et al. | |
| 7,728,566 | B2 | 6/2010 | Negoro et al. | |
| 7,944,663 | B2 | 5/2011 | Morino | |
| 7,965,475 | B2 | 6/2011 | Morino | |
| 7,974,060 | B2 | 7/2011 | Morino | |
| 2006/0152284 | A1 | 7/2006 | Morino | |
| 2009/0195227 | A1 | 8/2009 | Morino | |

FOREIGN PATENT DOCUMENTS

| | | |
|---|---|---|
| JP | 2003-208232 | 7/2003 |
| JP | 2004-252891 | 9/2004 |
| JP | 2005-165604 | 6/2005 |
| JP | 2005-327027 | 11/2005 |
| JP | 2007-219861 | 8/2007 |
| JP | 2007-251503 | 9/2007 |
| JP | 2007-310521 | 11/2007 |
| JP | 4061988 | 1/2008 |
| JP | 4181695 | 9/2008 |
| JP | 2008-282118 | 11/2008 |
| JP | 2008-287307 | 11/2008 |
| JP | 2008-310616 | 12/2008 |
| JP | 2009-48362 | 3/2009 |
| JP | 2009-211667 | 9/2009 |
| JP | 4393152 | 10/2009 |

(Continued)

*Primary Examiner* — Rajnikant Patel
(74) *Attorney, Agent, or Firm* — Cooper & Dunham LLP

(57) ABSTRACT

A voltage regulator includes a driver transistor, a feedback voltage generator, a reference voltage generator, a first differential amplifier, and a differential gain controller. The driver transistor is connected between input and output terminals to conduct a current therethrough according to a control signal applied to a gate terminal thereof. The feedback voltage generator is connected to the output terminal to generate a feedback voltage. The reference voltage generator generates a reference voltage. The first differential amplifier has an output thereof connected to the gate terminal of the driver transistor, and a pair of differential inputs thereof connected to the feedback voltage generator and the reference voltage generator, respectively, to generate the control signal at the output thereof. The differential gain controller is connected to the output of the first differential amplifier to control the differential gain according to a difference between the input and output voltages.

11 Claims, 13 Drawing Sheets

(56) References Cited

FOREIGN PATENT DOCUMENTS

| | | |
|---|---|---|
| JP | 4458457 | 2/2010 |
| JP | 4523473 | 6/2010 |
| JP | 4582705 | 9/2010 |
| JP | 4587804 | 9/2010 |

* cited by examiner

CONSTANT VOLTAGE REGULATOR

BACKGROUND OF THE INVENTION

1. Technical Field

The present invention relates to a constant voltage regulator, and more particularly, to a constant voltage regulator for power supply circuitry in electronic devices, such as personal computers and cellular phones, implementable in a low-current consumption integrated circuit (IC), which converts an input voltage input to an input terminal thereof into a regulated, output voltage output to an output terminal thereof.

2. Description of the Background Art

Voltage regulators are employed in power supply circuitry of various electronic devices, such as personal computers and cellular phones, which converts an input voltage input to an input terminal thereof into a regulated, output voltage for output to load circuitry, such as a microcontroller or other electronic components.

FIG. 1 is a circuit diagram schematically illustrating a configuration of a known constant voltage regulator 101.

As shown in FIG. 1, the voltage regulator 101 comprises a series regulator that converts an input voltage Vi supplied between an input terminal 111 and a ground terminal 112 to a regulated, constant output voltage Vo output to an output terminal 113.

The voltage regulator 101 includes a driver transistor M111, being a p-channel metal-oxide semiconductor (PMOS) device, having a source terminal thereof connected to the input terminal 111 and a drain terminal thereof connected to the output terminal 113; a pair of voltage divider resistors R111 and R112 connected in series between the output terminal 113 and the ground terminal 112 to form a feedback node therebetween; a reference voltage generator 116 connected to the ground terminal 112; and a differential amplifier EA111 having a non-inverting input thereof connected to the voltage divider node, an inverting input thereof connected to the reference voltage generator 116, and an output thereof connected to a gate terminal of the driver transistor M111.

During operation, the driver transistor M111 conducts an electric current therethrough according to a voltage applied across its gate and source terminals, so as to output a regulated output voltage Vo to the output terminal 113. The voltage divider resistors R111 and R112 generate a feedback voltage Vfb proportional to the output voltage Vo at the feedback node therebetween, whereas the reference voltage generator 116 generates a reference voltage Vref for comparison with the feedback voltage Vfb.

The differential amplifier EA111 compares the feedback voltage Vfb and the reference voltage Vref, so as to generate an error-amplified signal VEA at the output thereof by amplifying a difference between the differential input voltages Vfb and Vref. The amplifier output VEA thus generated is applied to the gate terminal of the driver transistor M111 to control operation of the same, thereby regulating the output voltage Vo to a desired, constant level.

With reference to FIG. 2, which is a detailed circuit diagram of the voltage regulator 101 of FIG. 1, the differential amplifier EA111 is shown including a differential pair of n-channel metal-oxide semiconductor (NMOS) transistors M112 and M113, the former having its gate terminal connected to the reference voltage generator 116, and the latter having its gate terminal connected to the feedback node between the voltage divider resistors R111 and R112; a current-mirror active load formed of a pair of PMOS transistors M114 and M115, the former connected in series with one differential transistor M112, and the latter connected in series with the other differential transistor M113, both having their gate terminals connected together to the drain terminal of the transistor M115; and a negatively-biased NMOS transistor M116 having one terminal grounded and another terminal connected to the differential pair to conduct a control current I111 therethrough.

To meet energy efficiency requirements of today's low-power consumption electronic devices, the voltage regulator 101 is required to operate with an extremely low current consumed through its differential amplification circuitry. To this end, the control current I111 of the differential amplifier EA111 is designed sufficiently small in amplitude, typically on the order of 500 nanoamperes to 5 microamperes, so as to reduce electronic current flowing through the multiple transistors.

FIGS. 3A and 3B are waveform diagrams showing the power supply input and output voltages Vi and Vo in volts (V), respectively, of the constant voltage regulator 101, each plotted against time in seconds (sec) during activation of the power supply circuitry.

As shown in FIGS. 3A and 3B, upon power-on, the input voltage Vi starts to rise at time t1, followed by the output voltage Vo rising toward a rated, constant level determined by the configuration of the reference voltage generator and the voltage divider resistors, which is typically 3.3 V with an allowance of ±10% for microcontroller applications. As the input voltage Vi continues to rise, the output voltage Vo reaches the rated output voltage at time t2, and then stops increasing to stabilize at the rated level at time t3.

During such initial stage upon power-on of the voltage regulator 101, the output voltage Vo upon reaching the rated level experiences a sharp, transient rise above the rated level, referred to in the art as "overshoot". Such voltage overshoot occurs due to a response delay caused where the voltage regulator 101 takes time to control the gate-to-source voltage of the driver transistor M111 from an initial, high level to an operational, low level approximately equal to a threshold voltage of the transistor M111 upon detecting that the feedback voltage Vfb reaches the reference voltage Vref.

Although typically encountered where the power supply voltage suddenly increases upon power-on, such phenomenon also takes place in today's low-power consumption electronics even where the power supply voltage exhibits a relatively large time constant larger than which is determined by the driver transistor's ON resistance and load current, as well as capacitance connected to the output terminal of the voltage regulator. If not corrected, voltage overshoot above the maximum allowable limit of the output voltage can result in runaway or other failures of the load circuit supplied therewith.

To date, various techniques have been proposed to provide overshoot-protected voltage regulation for power supply with a rise time of several microseconds per voltage, as described below with reference to FIGS. 4 through 7.

For example, one known technique provides a voltage regulator 401 as shown in FIG. 4. This voltage regulator 4011 includes a differential amplifier 430 to compare a feedback voltage Vfb against a reference voltage Vref to generate an error-amplified output signal to a regulator output terminal Vo provided with a stabilizer capacitor 461.

According to this method, the voltage regulator 401 also includes a comparator 440 to compare the feedback voltage Vfb against the reference voltage Vref, which outputs a result of comparison for activating and deactivating a switch or discharge circuit 450 connected between the output and ground terminals. When activated, the discharge circuit 450 causes the capacitor 461 to discharge electricity, so as to prevent excessive voltage overshoot upon startup of the power circuitry.

One drawback of this method is that overshoot protection provided by the comparator 440 and the discharge circuit 450 does not effectively work, where the comparator 440 exhibits a certain amount of offset voltage that causes a delay in responding to voltage overshoot. Moreover, the voltage regulator 401 requires a substantial amount of current consumed by the comparator 440 to obtain prompt comparator response for effective overshoot protection, which, however, makes it difficult to implement the voltage regulator 401 in an integrated circuit (IC) that consumes low current during operation.

Another known technique provides an overshoot protection circuit including a capacitor and resistors connected to an output of a voltage regulator, which monitors the output voltage to withdraw electric current from the output terminal upon detecting a transient change in the output voltage.

Such method has a drawback in that it requires a large value or size of capacitor and resistors forming the overshoot protection circuit to properly protect against voltage overshoot, where the power supply voltage as well as the output voltage rise upon power-on with a time constant larger than that which is determined by the driver transistor's ON-resistance and load current, and the capacitance connected to the output terminal. Due to such size requirement for the capacitor and resistors, which makes it difficult to implement the voltage regulator on a single IC, this method remains impractical or otherwise unduly expensive to practice.

Still another known technique provides a voltage regulator 501 as shown in FIG. 5. This voltage regulator 501 includes a driver transistor M511 connected between input and output terminals 511 and 513; a pair of resistors forming a voltage divider 506 connected to the output terminal 513 to output a feedback voltage; a reference voltage generator 516 to output a reference voltage Vref; and a differential amplifier EA511 having its differential inputs connected to the voltage divider 506 and the reference voltage generator 516, respectively, to output a control signal to a gate terminal of the driver transistor M511.

According to this method, the voltage regulator 501 also includes a soft start circuit 519 formed of a resistor and capacitor connected between the output of the reference voltage generator 516 and the input of the differential amplifier EA511, which provides the output of the reference voltage generator 516 with a time constant determined by the resistance and capacitance connected therewith, so as to protect the output voltage from excessive overshoot where the input voltage suddenly increases upon power-on.

As is the case with the overshoot protection circuit depicted above, such method has a drawback in that it requires a large value or size of capacitor and resistor forming the soft start circuit to properly protect against voltage overshoot, where the power supply voltage rises upon power-on with a time constant larger than that which is determined by the driver transistor's ON-resistance and load current, and the capacitance connected to the output terminal. Due to such size requirement for the capacitor and resistor, which makes it difficult to implement the voltage regulator on a single IC, this method remains impractical or otherwise unduly expensive to practice.

Still another known technique provides a voltage regulator 601 as shown in FIG. 6. This voltage regulator 601 includes a driver transistor Q611 connected between input and output terminals 611 and 613 to conduct a drain current Io therethrough; a pair of resistors forming a voltage divider 606 connected to the output terminal 613 to output a feedback voltage; a reference voltage generator 616 to output a reference voltage; and control circuitry formed of a differential amplifier EA611 having its differential inputs connected to the voltage divider 606 and the reference voltage generator 616, respectively, to output a control signal to a gate terminal of the driver transistor Q611.

According to this method, the voltage regulator 601 also includes a current limiter 619 connected to the input terminal 611 which limits the drain current of the driver transistor Q611 to protect the output voltage from excessive overshoot where the input voltage suddenly increases upon power-on.

Such method has a drawback in that it cannot effectively protect against voltage overshoot in case the drain current flowing through the driver transistor remains extremely low, for example, where the power supply voltage rises upon power-on with a time constant larger than that which is determined by the driver transistor's-ON resistance and load current, and the capacitance connected to the output terminal.

Yet still another known technique provides a voltage regulator 701 as shown in FIG. 7. This voltage regulator 701 includes a driver transistor M711 connected between input and output terminals 711 and 713; a pair of resistors forming a voltage divider 706 connected to the output terminal 713 to output a feedback voltage; a reference voltage generator 716 to output a reference voltage; a differential amplifier EA711 having its differential inputs connected to the voltage divider 706 and the reference voltage generator 716, respectively, to output a control signal to a gate terminal of the driver transistor M711; and a current limiter 742 to limit a current passing through the driver transistor M711.

According to this method, the voltage regulator 701 also includes a control transistor M753 connected between the source and gate terminals of the driver transistor M711, and an RC low-pass or high-pass filter consisting of a resistor 751 and a capacitor 752 connected in series to the input terminal 711, with a node therebetween connected to the gate terminal of the control transistor M753, which together form a time constant circuit that charges a transistor parasitic capacitance Cp as the filter detects a sudden change in the input voltage, so as to protect the output voltage from excessive overshoot where the input voltage suddenly increases upon power-on.

A similar method is proposed to provide overshoot protection with a low-pass or high-pass filter connected to a bias circuit that determines a control current supplied to the differential amplifier, wherein the bias circuit temporarily increases the control current as the filter detects a sudden change in the input voltage, so as to protect the output voltage from excessive overshoot where the input voltage suddenly increases upon power-on.

Either of such methods using a filter-based overshoot detector has a drawback in that it requires a large value or size of capacitor and resistor forming the RC filter to properly protect against voltage overshoot, where the power supply voltage rises upon power-on with a time constant larger than that which is determined by the driver transistor's ON-resistance and load current, and the capacitance connected to the output terminal. Due to such size requirement for the capacitor and resistor, which makes it difficult to implement the voltage regulator on a single IC, this method remains impractical or otherwise unduly expensive to practice.

BRIEF SUMMARY

This disclosure describes an improved voltage regulator that converts an input voltage input to an input terminal thereof into a regulated, output voltage output to an output terminal thereof.

In one aspect of the disclosure, the improved voltage regulator includes a driver transistor, a feedback voltage generator, a reference voltage generator, a first differential amplifier, and a differential gain controller. The driver transistor is connected between the input and output terminals to conduct a current therethrough according to a control signal applied to a gate terminal thereof. The feedback voltage generator is connected to the output terminal to generate a feedback voltage proportional to the output voltage. The reference voltage generator generates a reference voltage for comparison with the feedback voltage. The first differential amplifier has an output thereof connected to the gate terminal of the driver transistor, and a pair of differential inputs thereof connected to the feedback voltage generator and the reference voltage generator, respectively, to generate the control signal at the output thereof by amplifying a difference between the feedback voltage and the reference voltage with a variable differential gain. The differential gain controller is connected to the output of the first differential amplifier to control the differential gain according to a difference between the input and output voltages.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
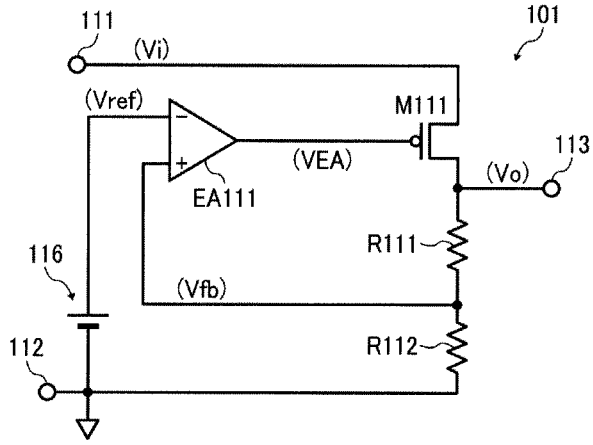
FIG. 1 BACKGROUND ART
FIG. 1 is a circuit diagram schematically illustrating a configuration of a known constant voltage regulator.
Figure 2:
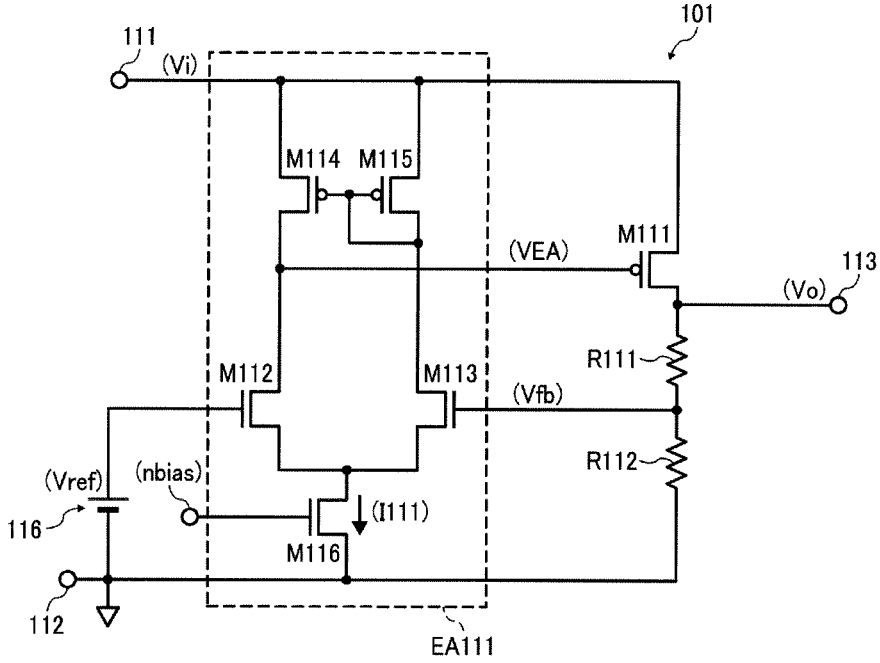
FIG. 2 BACKGROUND ART
FIG. 2 is a detailed circuit diagram of the voltage regulator of FIG. 1.
Figure 3A:
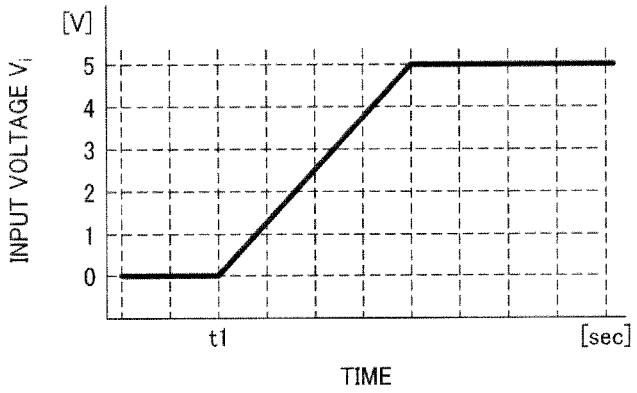
FIG. 3A BACKGROUND ART
FIGS. 3A and 3B are waveform diagrams showing the power supply input and output voltages in volts, respectively, of the constant voltage regulator of FIG. 1, each plotted against time in seconds during activation of the power supply circuitry.
Figure 3B:
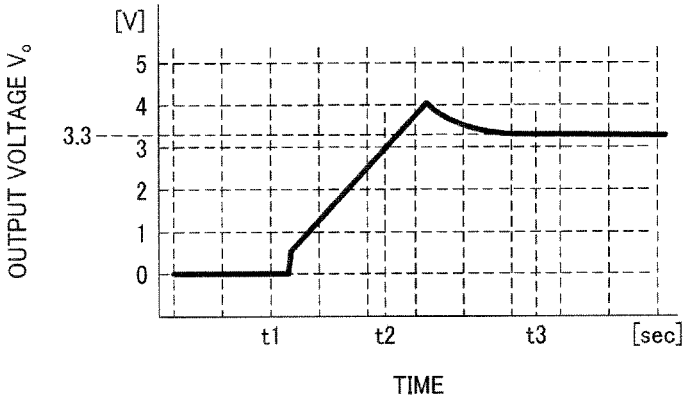
FIG. 3B BACKGROUND ART
Figure 4:
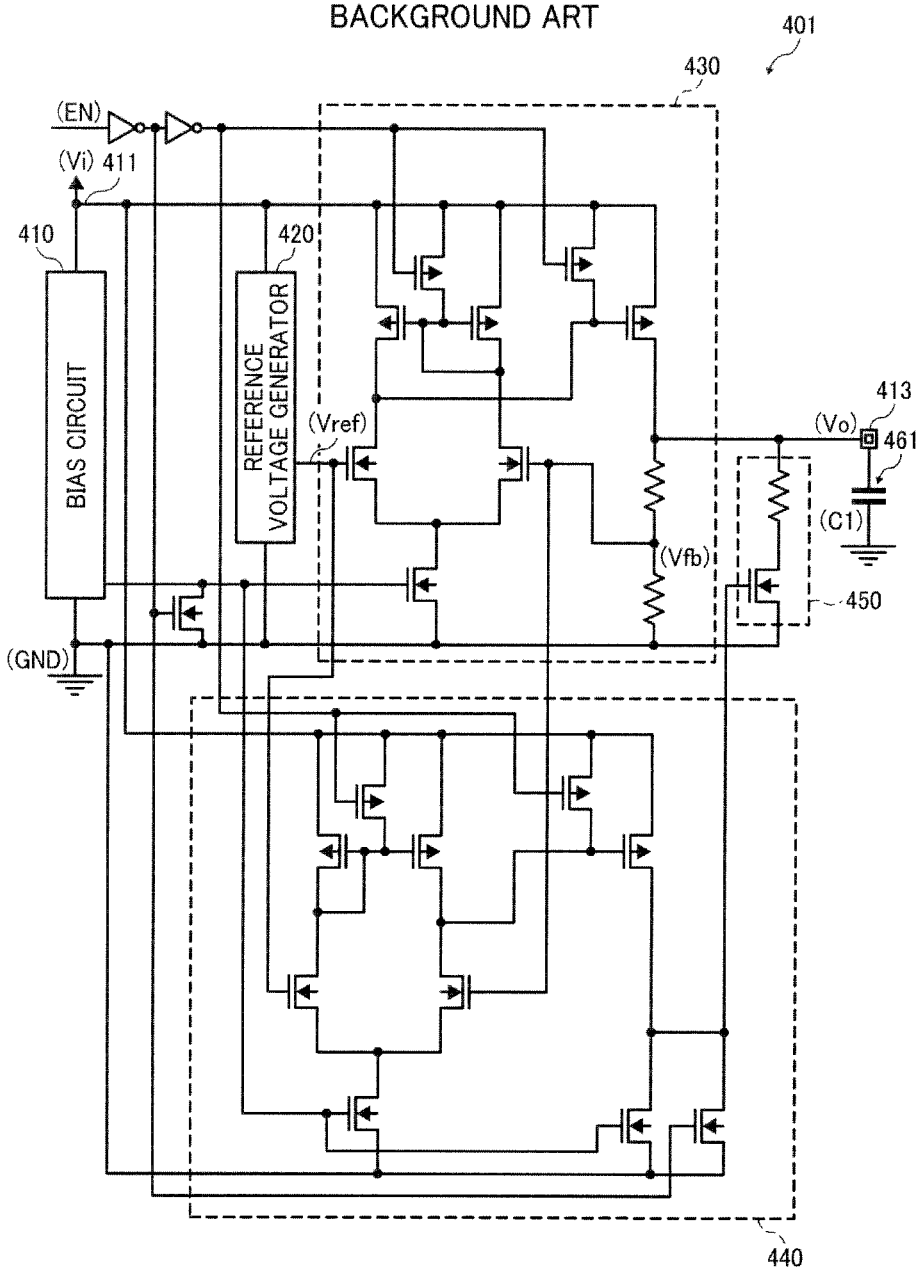
FIG. 4 BACKGROUND ART
FIG. 4 is a circuit diagram schematically illustrating a constant voltage regulator with overshoot protection capability.
Figure 5:
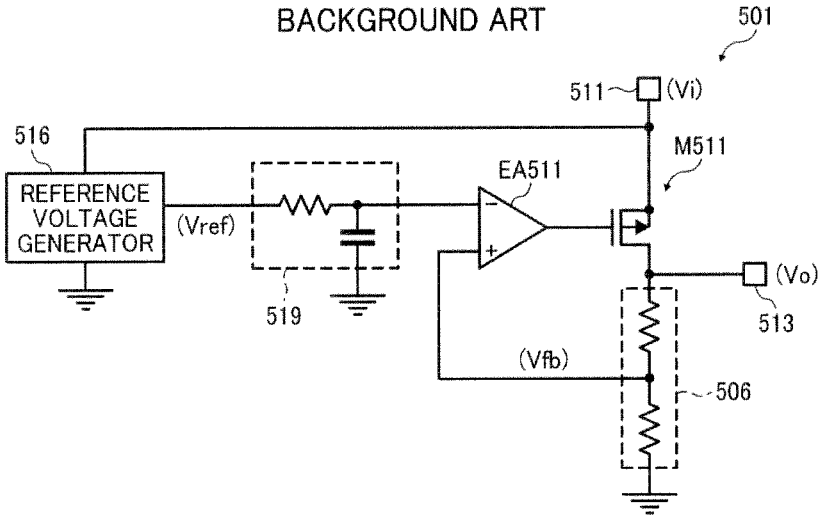
FIG. 5 BACKGROUND ART
FIG. 5 is a circuit diagram schematically illustrating another constant voltage regulator with overshoot protection capability.
Figure 6:
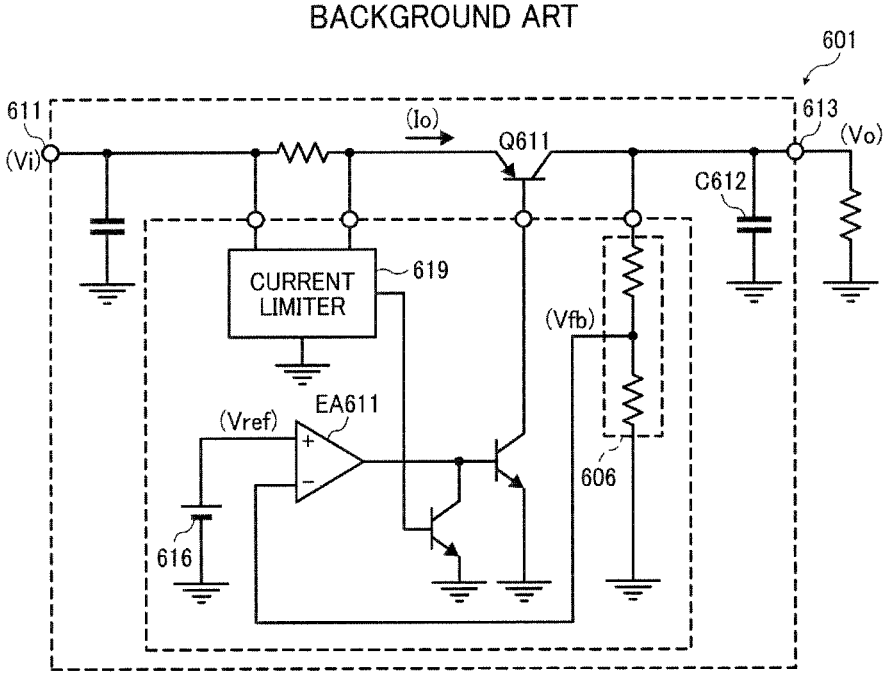
FIG. 6 BACKGROUND ART
FIG. 6 is a circuit diagram schematically illustrating a still another constant voltage regulator with overshoot protection capability.
Figure 7:
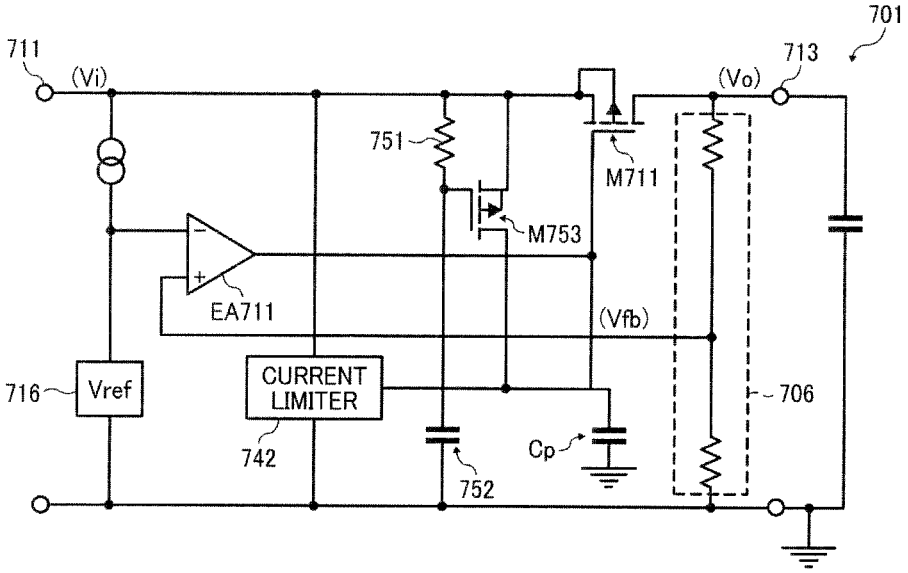
FIG. 7 BACKGROUND ART
FIG. 7 is a circuit diagram schematically illustrating a yet still another constant voltage regulator with overshoot protection capability.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, examples and exemplary embodiments of this disclosure are described.

Figure 8:
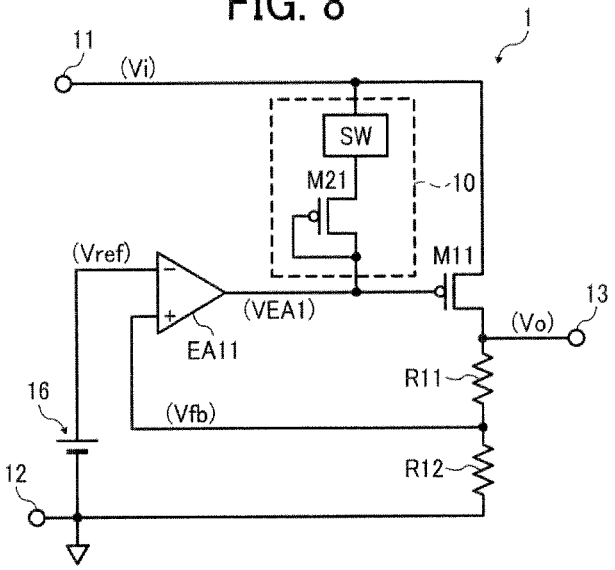
FIG. 8 is a circuit diagram schematically illustrating a constant voltage regulator according to a first embodiment of this patent specification.

FIG. 8 is a circuit diagram schematically illustrating a constant voltage regulator 1 according to a first embodiment of this patent specification.

As shown in FIG. 8, the constant voltage regulator 1 comprises a series regulator for power supply control in electronic devices, such as personal computers, cellular phones, and the like, which converts an input voltage Vi supplied between an input terminal 11 and a ground terminal 12 to a regulated, constant output voltage Vo for output to an output terminal 13 connected to load circuitry that operates with a rated voltage of, for example, 3.3 volts.

The voltage regulator 1 includes a driver transistor M11, being a p-channel metal-oxide semiconductor (PMOS) device, having a source terminal thereof connected to the input terminal 11 and a drain terminal thereof connected to the output terminal 13; a pair of voltage divider resistors R11 and R12 connected in series between the output terminal 13 and the ground terminal 12 to form a feedback generator node therebetween; a reference voltage generator 16 connected to the ground terminal; and a first differential amplifier EA11 having a non-inverting input thereof connected to the feedback generator node, an inverting input thereof connected to the reference voltage generator 16, and an output thereof connected to a gate terminal of the driver transistor M11.

During operation, the driver transistor M11 conducts an electric current therethrough according to a gate-to-source voltage Vgs applied between its gate and source terminals, so as to output a regulated output voltage Vo to the output terminal 13. The voltage divider resistors R11 and R12 generate a feedback voltage Vfb at the feedback generator node therebetween proportional to the output voltage Vo, whereas the reference voltage generator 16 generates a reference voltage Vref for comparison with the feedback voltage Vfb.

The differential amplifier EA11 compares the feedback voltage Vfb and the reference voltage Vref, so as to generate a first error-amplified, control signal VEA1 at the output thereof by amplifying a difference between the input voltages Vfb and Vref with a variable, adjustable gain G. The control signal VEA1 thus generated is applied to the gate terminal of the driver transistor M11 to control operation of the same, thereby regulating the output voltage Vo to a desired, constant level.

With further reference to FIG. 8, also included in the constant voltage regulator 1 is a differential gain controller 10 that includes a switch SW disposed between the input terminal 11 and the output of the differential amplifier EA11, and a diode-connected PMOS transistor M21 having a source terminal thereof connectable to the input terminal 11 via the switch SW, and gate and drain terminals thereof connected together to the output of the differential amplifier EA11.

According to this patent specification, the differential gain controller 10 controls the gain G of the first differential amplifier EA11 according to a difference Vd between the power supply input and output voltages Vi and Vo of the voltage regulator 1, wherein the switch SW turns on and off an electrical current flow from the input terminal 11 to the source terminal of the diode-connected transistor M21 depending on the differential voltage Vd, so as to enable and disable the diode-connected transistor M21 to electrically connect to, or interfere with, the output VEA1 of the differential amplifier EA11 determining a maximum gate-to-source voltage Vgs applied across the driver transistor M11.

Figure 9:
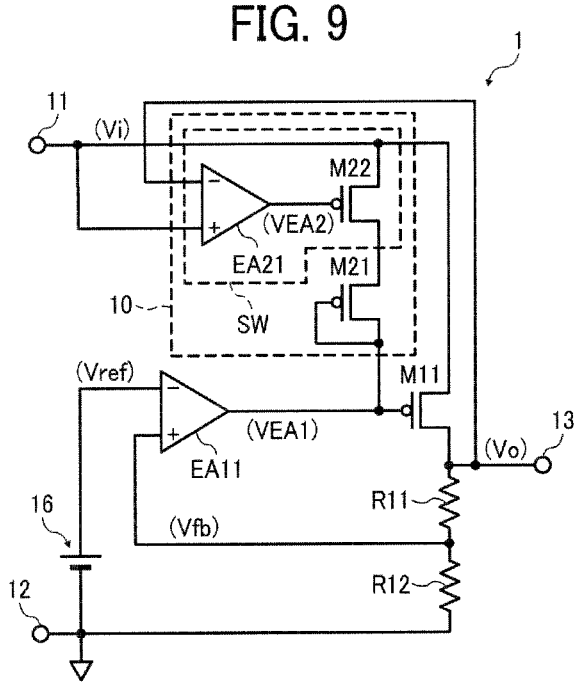
FIG. 9 is a detailed circuit diagram of the constant voltage regulator of FIG. 8.

With reference to FIG. 9, which is a detailed circuit diagram of the constant voltage regulator 1 of FIG. 8, the switch SW of the gain controller 10 is shown including a switchable PMOS transistor M22 connected in series with the diode-connected transistor M21 between the input terminal 11 and the output of the differential amplifier EA11, as well as a second differential amplifier EA21 having a non-inverting input thereof connected to the input terminal 11, an inverting input thereof connected to the output terminal 13, and an output thereof connected to a gate terminal of the switchable transistor M22.

During operation, the second differential amplifier EA21 compares the output voltage Vo against the input voltage Vi, so as to output a second error-amplified signal VEA2 to the gate terminal of the switchable transistor M22. In generating the output signal VEA2, the differential amplifier EA21 exhibits a threshold, offset voltage Va (i.e., the difference Vi−Vo between the non-inverting and inverting inputs with which the amplifier output switches from one level to another) ranging from approximately −1 to 2 volts, so that its output signal VEA2 goes high where the differential voltage Vd exceeds the offset voltage Va, and goes low where the differential voltage Vd falls below the offset voltage Va.

Specifically, where the differential voltage Vd exceeds the offset voltage Va, the second differential amplifier EA21 outputs a high voltage signal VEA2 to turn off the PMOS transistor M22, so as to disable the diode-connected transistor M21 to electrically interfere with the output VEA1 of the differential amplifier EA11.

With the switch SW thus turned off, the maximum gate-to-source voltage Vgs of the driver transistor M11 remains at a first, normal level, so that the first differential amplifier EA11 generates an error-amplified signal VEA1 with a normal, first gain G1.

Contrarily, where the differential voltage Vd falls below the offset voltage Va, the second differential amplifier EA21 outputs a low voltage signal VEA2 to turn on the PMOS transistor M22, so as to enable the diode-connected transistor M21 to electrically interfere with the output VEA1 of the first differential amplifier EA11, that is, to cause an electrical current to flow from the input terminal 11 to the output of the differential amplifier EA11 through the transistors M21 and M22 connected in series.

With the switch SW thus turned on, the maximum gate-to-source voltage Vgs of the driver transistor M11 remains at a second, reduced level lower than the first level, so that the first differential amplifier EA11 generates an error-amplified output VEA1 with a reduced, second gain G2 lower than the normal gain G1.

Thus, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the offset voltage Va, and to the second level G2 lower than the first level G1 where the differential voltage Vd falls below the offset voltage Va.

Such adjustment of the differential gain G1 is readily obtained by the combination of the switch SW and the diode-connected transistor M21, which switches the differential gain by adjusting the maximum gate-to-source voltage across the driver transistor M11 to the first level where the differential voltage Vd exceeds the offset voltage Va, and to the second level lower than the first level where the differential voltage Vd falls below the offset voltage Va.

Figure 10A:
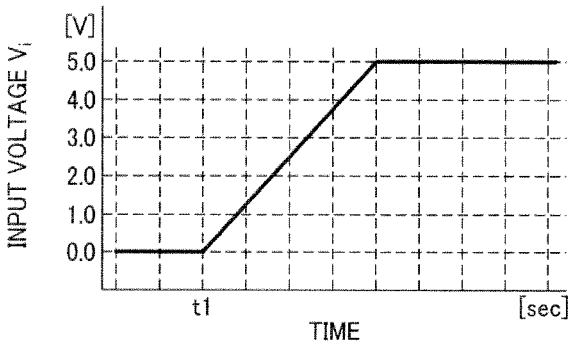
FIGS. 10A and 10B are waveform diagrams showing the power supply input and output voltages in volts, respectively, of the constant voltage regulator of FIG. 8, each plotted against time in seconds during activation of the power supply circuitry.
Figure 10B:
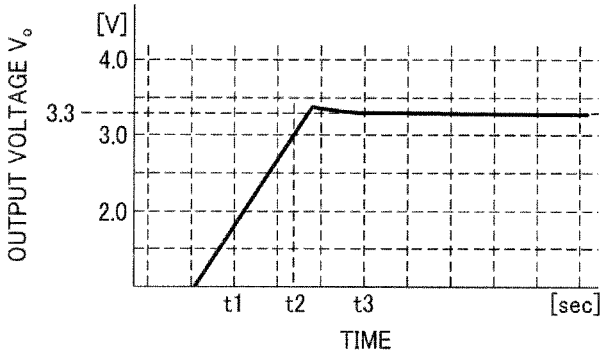

FIGS. 10A and 10B are waveform diagrams showing the power supply input and output voltages Vi and Vo in volts (V), respectively, of the constant voltage regulator 1, each plotted against time in seconds (sec) during activation of the power supply circuitry.

As shown in FIGS. 10A and 10B, upon power-on, the input voltage Vi starts to rise at time t1. The output voltage rises toward a rated output voltage of approximately 3.0 V, as the driver transistor M11 has its gate-to-source voltage Vgs forced to an initial, high level as long as the output voltage Vo remains below the rated voltage.

As the input voltage Vi continues to rise, the output voltage Vo reaches the rated output voltage at time t2. The output voltage Vo then stops increasing to stabilize at the rated level at time t3, as the driver transistor M11 has its gate-to-source voltage Vgs forced to an operational level approximately equal to its threshold voltage where the output voltage Vo exceeds the rated voltage.

During such initial stage upon power-on of the voltage regulator 1, the input and output voltages Vi and Vo change in conformity with each other, which results in a reduced differential voltage Vd smaller than that obtained during normal operation after activation of the power supply circuitry. As the differential voltage Vd thus reduced falls below the offset voltage Va, the second differential amplifier EA21 outputs a low voltage signal VEA2 to turn on the PMOS transistor M22, so that the first differential amplifier EA11 has its gain maintained at the reduced, second level G2.

In general, the output voltage of a voltage regulator upon power-on exhibits a sharp, transient rise above the rated level, referred to in the art as "overshoot". Such voltage overshoot, if significant, would result in runaway or other failures of load circuitry supplied with the voltage regulator. The amount of overshoot is substantially dependent on the time during which the gate-to-source voltage of the driver transistor is reduced from the initial high level to the operational level substantially equal to the transistor threshold voltage upon detecting the output voltage exceeds the rated voltage. That is, the faster the driver transistor has its gate-to-source voltage reduced from the initial high level to the operational level upon power-on, the smaller the voltage overshoot in the voltage regulator.

According to this patent specification, the voltage regulator 1 is protected against excessive overshoot of the output voltage Vo upon power-on, wherein the differential gain controller 10 reduces the gain G of the first differential amplifier EA11, which controls the gate voltage of the driver transistor M11, where the difference Vd between the input and output voltage Vi and Vo falls below the threshold, offset voltage Va, so as to effectively shorten the time during which the gate-to-source voltage Vgs of the driver transistor M11 changes from the initial high level to the operational level.

Figure 11:
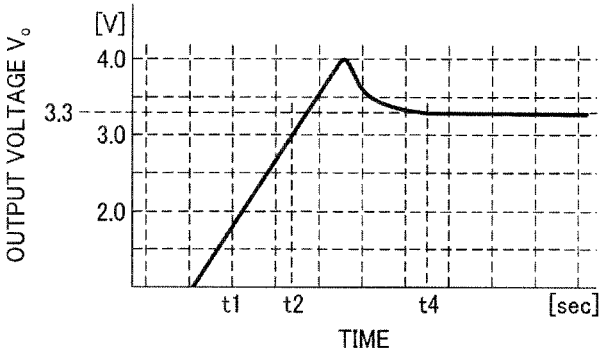
FIG. 11 is a waveform diagram of an output voltage obtained in a voltage regulator configured without an differential gain controller.

With additional reference to FIG. 11, which is a waveform diagram of an output voltage Vo obtained in a voltage regulator configured without an differential gain controller, the output voltage Vo exhibits a significant amount of overshoot upon power-on before stabilizing at a rated level of 3.3 V at time t4. By contrast, as shown in FIG. 10B, the output voltage Vo of the voltage regulator 1 according to this patent specification does not significantly deviate from the rated level of 3.3 V, exhibiting a comparatively reduced amount of overshoot upon power-on before stabilizing at a rated level of 3.3 V at time t3.

Figure 12:
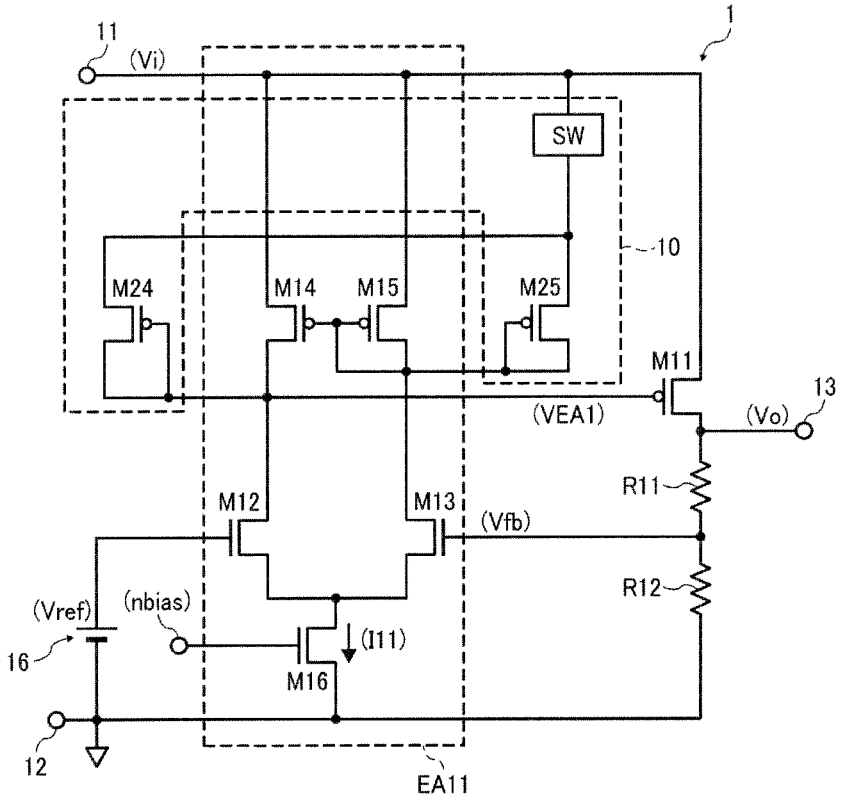
FIG. 12 is a circuit diagram schematically illustrating the constant voltage regulator according to a second embodiment of this patent specification.

FIG. 12 is a circuit diagram schematically illustrating the constant voltage regulator 1 according to a second embodiment of this patent specification.

As shown in FIG. 12, the overall configuration of the present embodiment is similar to that depicted in FIG. 8, except that the differential gain controller 10 includes a pair of first and second, diode-connected PMOS transistors M24 and M25, instead of a single diode-connected transistor M21, each connected in series with the switch SW.

Specifically, in the present embodiment, the first differential amplifier EA11 has a substantially symmetrical configuration including a differential pair of n-channel metal-oxide semiconductor (NMOS) transistors M12 and M13, the former having its gate terminal connected to the reference voltage generator 16, and the latter having its gate terminal connected to the feedback node between the voltage divider resistors R11 and R12; a current-mirror active load formed of a pair of PMOS transistors M14 and M15, the former connected in series with one differential transistor M12, and the latter connected in series with the other differential transistor M13, both having their gate terminals connected together to the drain terminal of the transistor M15; and a negatively-biased NMOS transistor M16 having one terminal grounded and another terminal connected to the differential pair to conduct a control current I11 therethrough.

In the differential gain controller 10, the switch SW is disposed between the input terminal 11 and the output of the differential amplifier EA11, as is the case with the first embodiment. The first diode-connected transistor M24 has a source terminal thereof connectable to the input terminal 11 via the switch SW, and gate and drain terminals thereof connected together to the output of the differential amplifier EA11, whereas the second diode-connected transistor M25 has a source terminal thereof connectable to the input terminal 11 via the switch SW, and gate and drain terminals thereof connected together to the drain terminal of the active load transistor M15.

In such a configuration, the gain controller 10 controls the gain G of the first differential amplifier EA11 in a manner similar to that depicted in the foregoing embodiments, wherein the switch SW turns on and off an electrical current flow from the input terminal 11 to the source terminals of the diode-connected transistors M24 and M25 depending on the differential voltage Vd, so as to enable and disable the diode-connected transistors M24 and M25 to electrically connect to, or interfere with, the output VEA1 of the differential amplifier EA11 determining a maximum gate-to-source voltage Vgs applied across the driver transistor M11.

Particularly in the present embodiment, provision of the paired diode-connected transistors M24 and M25 in the differential gain controller 10 allows for consistent symmetry and balance between the differential pair of the first differential amplifier EA11, compared to a configuration with a single diode-connected transistor.

Figure 13:
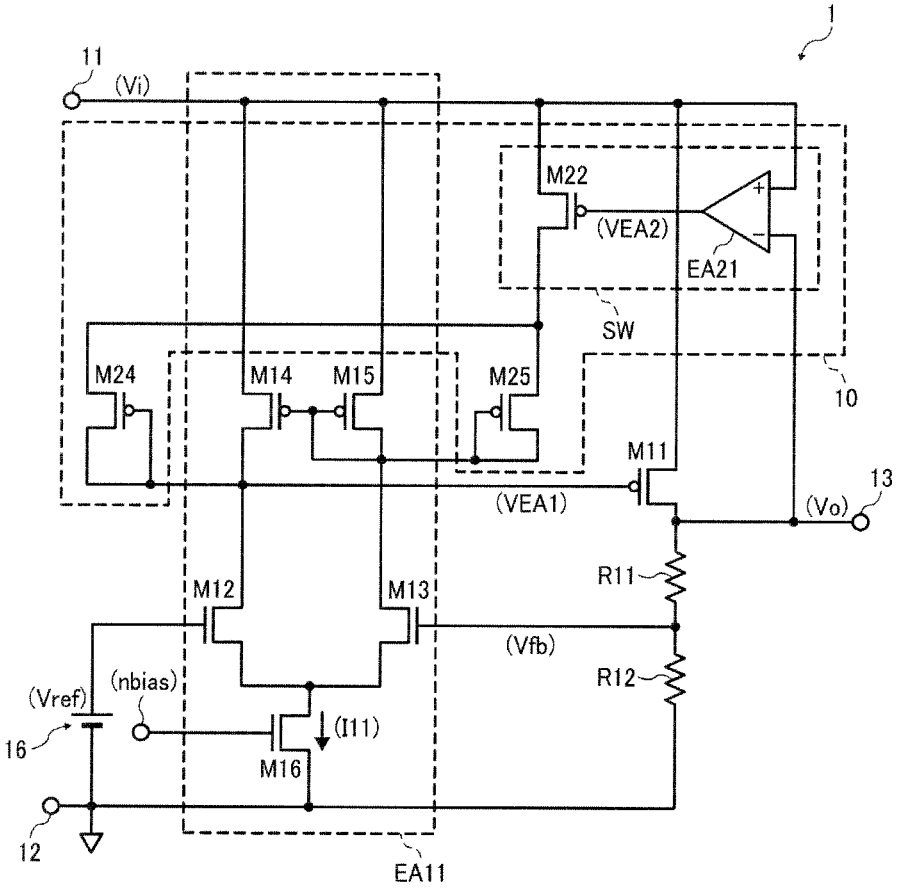
FIG. 13 is a detailed circuit diagram of the constant voltage regulator of FIG. 12.

With reference to FIG. 13, which is a detailed circuit diagram of the constant voltage regulator 1 of FIG. 12, the switch SW of the gain controller 10 is shown including a switchable PMOS transistor M22 connected in series with the first diode-connected transistor M24 between the input terminal 11 and the output of the differential amplifier EA11, and with the second diode-connected transistor M25 between the input terminal 11 and the drain terminal of the active load transistor M15. The switch SW also includes a second differential amplifier EA21 having a non-inverting input thereof connected to the input terminal 11, an inverting input thereof connected to the output terminal 13, and an output thereof connected to a gate terminal of the switchable transistor M22.

During operation, the differential amplifier EA21 compares the output voltage Vo against the input voltage Vi, so as to output an error-amplified signal VEA2 to the gate terminal of the switchable transistor M22. In generating the output signal VEA2, the differential amplifier EA21 exhibits a threshold, offset voltage Va (i.e., the difference Vi−Vo between the non-inverting and inverting inputs with which the amplifier output switches from one level to another) ranging from approximately −1 to 2 volts, so that its output signal VEA2 goes high where the differential voltage Vd exceeds the offset voltage Va, and goes low where the differential voltage Vd falls below the offset voltage Va.

Specifically, where the differential voltage Vd exceeds the offset voltage Va, the second differential amplifier EA21 outputs a high voltage signal VEA2 to turn off the PMOS transistor M22, so as to disable the diode-connected transistors M24 and M25 to electrically interfere with the output VEA1 of the differential amplifier EA11.

With the switch SW thus turned off, the first differential amplifier EA11 generates an error-amplified signal VEA1 with a normal, first gain G1.

Contrarily, where the differential voltage Vd falls below the offset voltage Va, the second differential amplifier EA21 outputs a low voltage signal VEA2 to turn on the PMOS transistor M22, so as to enable the diode-connected transistor M24 to electrically interfere with the output VEA1 of the first differential amplifier EA11, that is, to cause an electrical current to flow from the input terminal 11 to the output of the differential amplifier EA11 through the transistors M22 and M24 connected in series.

With the switch SW thus turned on, the first differential amplifier EA11 generates an error-amplified output VEA1 with a reduced, second gain G2 lower than the normal gain G1.

Thus, as is the case with the first embodiment, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the offset voltage Va, and to the second level G2 lower than the first level G1 where the differential voltage Vd falls below the offset voltage Va.

Figure 14:
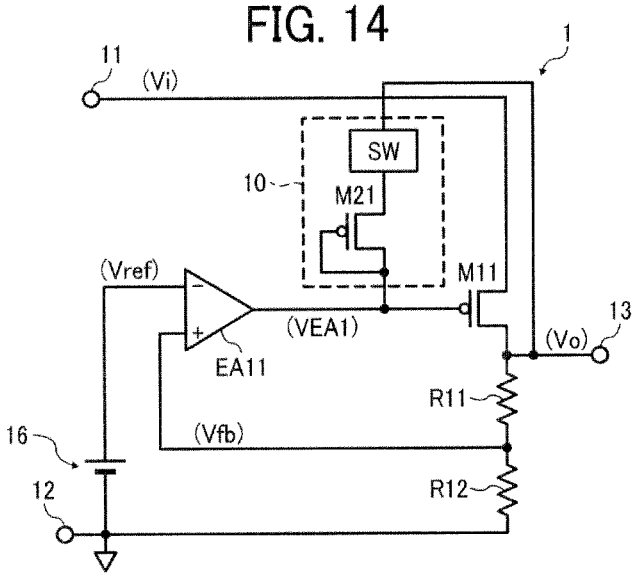
FIG. 14 is a circuit diagram schematically illustrating the constant voltage regulator according to a third embodiment of this patent specification.

FIG. 14 is a circuit diagram schematically illustrating the constant voltage regulator 1 according to a third embodiment of this patent specification.

As shown in FIG. 14, the overall configuration of the present embodiment is similar to that depicted in FIG. 8, except that the differential gain controller 10 derives a current for conduction to the gate of the driver transistor M11 from the output terminal 13 instead of the input terminal 11 of the voltage regulator 1.

Specifically, in the present embodiment, the switch SW is disposed between the output terminal 13 and the output of the first differential amplifier EA11. The diode-connected transistor M21 has a source terminal thereof connectable to the output terminal 13 via the switch SW, and gate and drain terminals thereof connected together to the output of the differential amplifier EA11.

In such a configuration, the gain controller 10 controls the gain G of the first differential amplifier EA11 in a manner similar to that depicted in the foregoing embodiments, wherein the switch SW turns on and off an electrical current flow from the output terminal 13 to the source terminal of the diode-connected transistor M21 depending on the differential voltage Vd, so as to enable and disable the diode-connected transistor M21 to electrically connect to, or interfere with, the output VEA1 of the differential amplifier EA11 determining a maximum gate-to-source voltage Vgs applied across the driver transistor M11.

Figure 15:
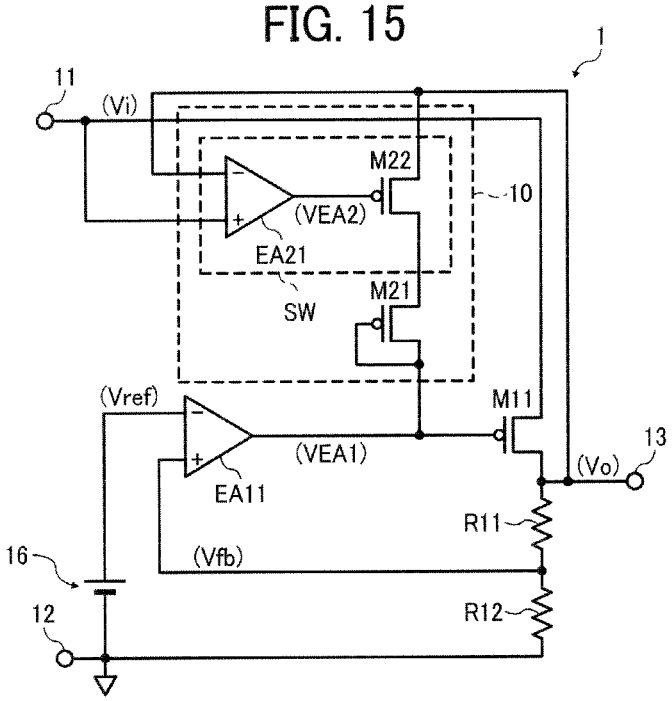
FIG. 15 is a detailed circuit diagram of the constant voltage regulator of FIG. 14.

With reference to FIG. 15, which is a detailed circuit diagram of the constant voltage regulator 1 of FIG. 14, the switch SW of the gain controller 10 is shown including a switchable PMOS transistor M22 connected in series with the diode-connected transistor M21 between the output terminal 13 and the output of the differential amplifier EA11, as well as a second differential amplifier EA21 having a non-inverting input thereof connected to the input terminal 11, an inverting input thereof connected to the output terminal 13, and an output thereof connected to a gate terminal of the switchable transistor M22.

During operation, the differential amplifier EA21 compares the output voltage Vo against the input voltage Vi, so as to output an error-amplified signal VEA2 to the gate terminal of the switchable transistor M22. In generating the output signal VEA2, the differential amplifier EA21 exhibits a threshold, offset voltage Va (i.e., the difference Vi−Vo between the non-inverting and inverting inputs with which the amplifier output switches from one level to another) ranging from approximately −1 to 2 volts, so that its output signal VEA2 goes high where the differential voltage Vd exceeds the offset voltage Va, and goes low where the differential voltage Vd falls below the offset voltage Va.

Specifically, where the differential voltage Vd exceeds the offset voltage Va, the second differential amplifier EA21 outputs a high voltage signal VEA2 to turn off the PMOS transistor M22, so as to disable the diode-connected transistor M21 to electrically interfere with the output VEA1 of the differential amplifier EA11.

With the switch SW thus turned off, the first differential amplifier EA11 generates an error-amplified signal VEA1 with a normal, first gain G1.

Contrarily, where the differential voltage Vd falls below the offset voltage Va, the second differential amplifier EA21 outputs a low voltage signal VEA2 to turn on the PMOS transistor M22, so as to enable the diode-connected transistor M21 to electrically interfere with the output VEA1 of the first differential amplifier EA11, that is, to cause an electrical current to flow from the output terminal 13 to the output of the differential amplifier EA11 through the transistors M21 and M22 connected in series.

With the switch SW thus turned on, the first differential amplifier EA11 generates an error-amplified output VEA1 with a reduced, second gain G2 lower than the normal gain G1.

Thus, as is the case with the first embodiment, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the offset voltage Va, and to the second level G2 lower than the first level G1 where the differential voltage Vd falls below the offset voltage Va.

Such voltage regulation provided with differential gain control according to the third embodiment results in a suppressed overshoot voltage with the power supply input and output voltages Vi and Vo exhibiting similar characteristics as those obtained in the first embodiment depicted in FIGS. 10A and 10B.

Figure 16:
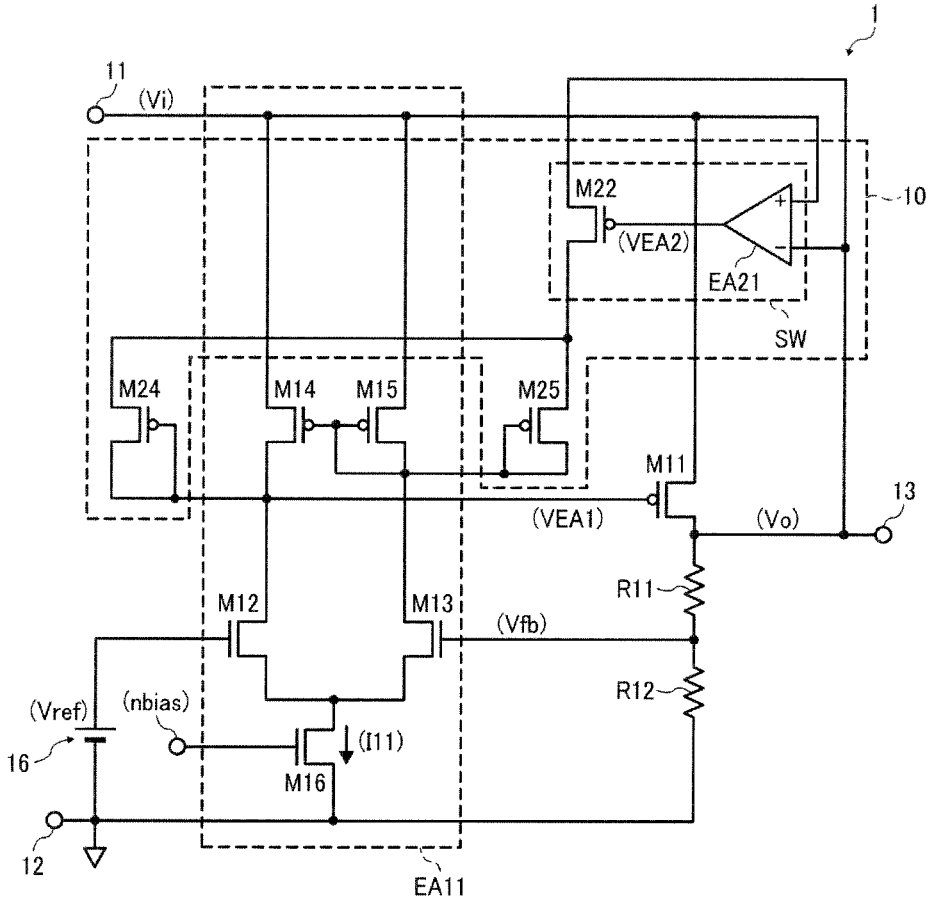
FIG. 16 is a circuit diagram schematically illustrating the constant voltage regulator according to a fourth embodiment of this patent specification.

FIG. 16 is a circuit diagram schematically illustrating the constant voltage regulator 1 according to a fourth embodiment of this patent specification.

As shown in FIG. 16, the overall configuration of the present embodiment is similar to that depicted primarily with reference to FIG. 15, except that the differential gain controller 10 includes a pair of first and second, diode-connected PMOS transistors M24 and M25, instead of a single diode-connected transistor M21, each connected in series with the switch SW.

Specifically, in the present embodiment, the first differential amplifier EA11 has a substantially symmetrical configuration including a differential pair of NMOS transistors M12 and M13, the former having its gate terminal connected to the reference voltage generator 16, and the latter having its gate terminal connected to the feedback node between the voltage divider resistors R11 and R12; a current-mirror active load formed of a pair of PMOS transistors M14 and M15, the former connected in series with one differential transistor M12, and the latter connected in series with the other differential transistor M13, both having their gate terminals connected together to the drain terminal of the transistor M15; and a negatively-biased NMOS transistor M16 having one terminal grounded and another terminal connected to the differential pair to conduct a control current I11 therethrough.

In the differential gain controller 10, the switch SW is disposed between the output terminal 13 and the output of the first differential amplifier EA11, as is the case with the third embodiment. The first diode-connected transistor M24 has a source terminal thereof connectable to the output terminal 13 via the switch SW, and gate and drain terminals thereof connected together to the output of the differential amplifier EA11, whereas the second diode-connected transistor M25 has a source terminal thereof connectable to the output terminal 13 via the switch SW, and gate and drain terminals thereof connected together to the drain terminal of the active load transistor M15.

In such a configuration, the gain controller 10 controls the gain G of the first differential amplifier EA11 in a manner similar to that depicted in the foregoing embodiments, wherein the switch SW turns on and off an electrical current flow from the output terminal 13 to the source terminals of the diode-connected transistors M24 and M25 depending on the differential voltage Vd, so as to enable and disable the diode-connected transistors M24 and M25 to electrically connect to, or interfere with, the output VEA1 of the differential amplifier EA11 determining a maximum gate-to-source voltage Vgs applied across the driver transistor M11.

Particularly in the present embodiment, provision of the paired diode-connected transistors M24 and M25 in the differential gain controller 10 allows for consistent symmetry and balance between the differential pair of the first differential amplifier EA11, compared to a configuration with a single diode-connected transistor.

With continued reference to FIG. 16, the switch SW of the gain controller 10 is shown including a switchable PMOS transistor M22 connected in series with the first diode-connected transistor M24 between the output terminal 13 and the output of the differential amplifier EA11, and with the second diode-connected transistor M25 between the output terminal 13 and the drain terminal of the active load transistor M15. The switch SW also includes a second differential amplifier EA21 having a non-inverting input thereof connected to the input terminal 11, an inverting input thereof connected to the output terminal 13, and an output thereof connected to a gate terminal of the switchable transistor M22.

During operation, the differential amplifier EA21 compares the output voltage Vo against the input voltage Vi, so as to output an error-amplified signal VEA2 to the gate terminal of the switchable transistor M22. In generating the output signal VEA2, the differential amplifier EA21 exhibits a threshold, offset voltage Va (i.e., the difference Vi−Vo between the non-inverting and inverting inputs with which the amplifier output switches from one level to another) ranging from approximately −1 to 2 volts, so that its output signal VEA2 goes high where the differential voltage Vd exceeds the offset voltage Va, and goes low where the differential voltage Vd falls below the offset voltage Va.

Specifically, where the differential voltage Vd exceeds the offset voltage Va, the second differential amplifier EA21 outputs a high voltage signal VEA2 to turn off the PMOS transistor M22, so as to disable the diode-connected transistors M24 and M25 to electrically interfere with the output VEA1 of the differential amplifier EA11.

With the switch SW thus turned off, the first differential amplifier EA11 generates an error-amplified signal VEA1 with a normal, first gain G1.

Contrarily, where the differential voltage Vd falls below the offset voltage Va, the second differential amplifier EA21 outputs a low voltage signal VEA2 to turn on the PMOS transistor M22, so as to enable the diode-connected transistor M24 to electrically interfere with the output VEA1 of the first differential amplifier EA11, that is, to cause an electrical current to flow from the output terminal 13 to the output of the differential amplifier EA11 through the transistors M22 and M24 connected in series.

With the switch SW thus turned on, the first differential amplifier EA11 generates an error-amplified output VEA1 with a reduced, second gain G2 lower than the normal gain G1.

Thus, as is the case with the first embodiment, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the offset voltage Va, and to the second level G2 lower than the first level G1 where the differential voltage Vd falls below the offset voltage Va.

Figure 17:
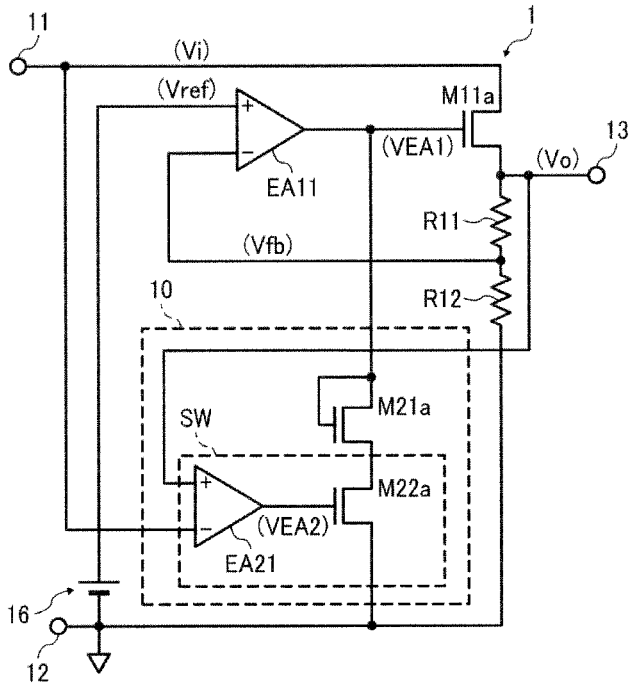
FIG. 17 is a circuit diagram schematically illustrating the constant voltage regulator according to a fifth embodiment of this patent specification.

FIG. 17 is a circuit diagram schematically illustrating the constant voltage regulator 1 according to a fifth embodiment of this patent specification.

As shown in FIG. 17, the overall configuration of the present embodiment is similar to the first embodiment depicted in FIG. 9, except for the polarity of the driver transistor employed in the voltage regulator 1.

Specifically, in the present embodiment, unlike the first embodiment, the driver transistor of the voltage regulator 1 is configured as an NMOS transistor M11*a* connected between the input and output terminals 11 and 13, having a drain terminal thereof connected to the input terminal 11 and a source terminal thereof connected to the output terminal 13 to conduct an electric current therethrough according to a gate-to-source voltage Vgs applied between its gate and source terminals. Also unlike the first embodiment, the diode-connected transistor of the differential gain controller 10 is configured as an NMOS transistor M21*a* having a source terminal thereof connectable to the ground terminal 12 via the switch SW, and gate and drain terminals thereof connected together to the output of the differential amplifier EA11*a*.

In such a configuration, the gain controller 10 controls the gain G of the first differential amplifier EA11 in a manner similar to that depicted in the foregoing embodiments, wherein the switch SW turns on and off an electrical current flow from the ground terminal 12 to the source terminal of the diode-connected transistor M21*a* depending on the differential voltage Vd, so as to enable and disable the diode-connected transistor M21*a* to electrically connect to, or interfere with, the output VEA1 of the differential amplifier EA11 determining a maximum gate-to-source voltage Vgs applied across the driver transistor M11*a*.

With continued reference to FIG. 17, the switch SW of the gain controller 10 is shown including a switchable NMOS transistor M22*a* connected in series with the diode-connected transistor M21*a* between the ground terminal 12 and the output of the differential amplifier EA11*a*, as well as a second differential amplifier EA21 having a non-inverting input thereof connected to the output terminal 12, an inverting input thereof connected to the input terminal 11, and an output thereof connected to a gate terminal of the switchable transistor M22*a*.

During operation, the differential amplifier EA21 compares the output voltage Vo against the input voltage Vi, so as to output an error-amplified signal VEA2 to the gate terminal of the switchable transistor M22*a*. In generating the output signal VEA2, the differential amplifier EA21 exhibits a threshold, offset voltage Va (i.e., the difference Vi−Vo between the inverting and non-inverting inputs with which the amplifier output switches from one level to another) ranging from approximately −1 to 2 volts, so that its output signal VEA2 goes low where the differential voltage Vd exceeds the offset voltage Va, and goes high where the differential voltage Vd falls below the offset voltage Va.

Specifically, where the differential voltage Vd exceeds the offset voltage Va, the second differential amplifier EA21 outputs a low voltage signal VEA2 to turn off the NMOS transistor M22*a*, so as to disable the diode-connected transistor M21*a* to electrically interfere with the output VEA1 of the differential amplifier EA11.

With the switch SW thus turned off, the first differential amplifier EA11 generates an error-amplified signal VEA1 with a normal, first gain G1.

Contrarily, where the differential voltage Vd falls below the offset voltage Va, the second differential amplifier EA21 outputs a high voltage signal VEA2 to turn on the NMOS transistor M22*a*, so as to enable the diode-connected transistor M21*a* to electrically interfere with the output VEA1 of the first differential amplifier EA11, that is, to cause an electrical current to flow from the ground terminal 12 to the output of the differential amplifier EA11 through the transistors M21*a* and M22*a* connected in series.

With the switch SW thus turned on, the first differential amplifier EA11 generates an error-amplified output VEA1 with a reduced, second gain G2 lower than the normal gain G1.

Thus, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the offset voltage Va, and to the second level G2 lower than the first level G1 where the differential voltage Vd falls below the offset voltage Va.

Such voltage regulation provided with differential gain control according to the fifth embodiment results in a suppressed overshoot voltage with the power supply input and output voltages Vi and Vo exhibiting similar characteristics as those obtained in the first embodiment depicted in FIGS. 10A and 10B.

Figure 18:
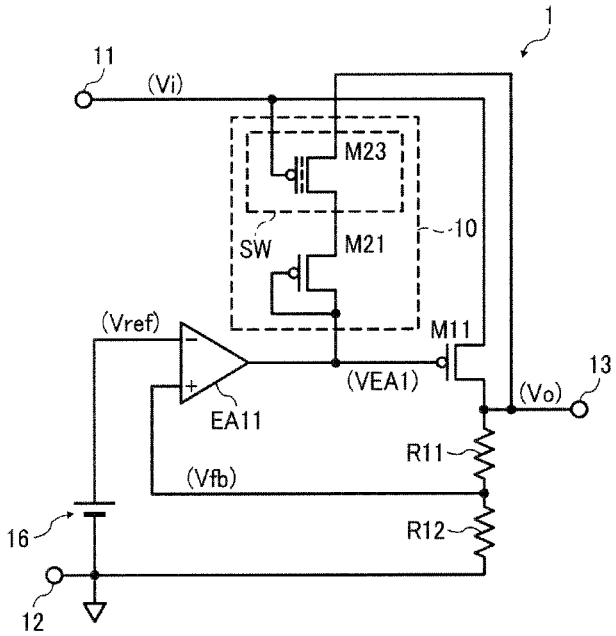
FIG. 18 is a circuit diagram schematically illustrating the constant voltage regulator according to a sixth embodiment of this patent specification.

FIG. 18 is a circuit diagram schematically illustrating the constant voltage regulator 1 according to a sixth embodiment of this patent specification.

As shown in FIG. 18, the overall configuration of the present embodiment is similar to the third embodiment depicted in FIG. 15, except that the differential gain controller 10 has its switch SW configured as a single, switchable depletion-mode PMOS transistor M23 connected in series with the diode-connected transistor M21 between the output terminal 13 and the output of the differential amplifier EA11 instead of the combination of the differential amplifier EA21 and the PMOS transistor M22.

Specifically, in the present embodiment, the depletion-mode transistor M23 has a drain terminal thereof connected to the diode-connected transistor M21, a source terminal thereof connected to the output terminal 13, and a gate terminal thereof connected to the input terminal 11. The diode-connected transistor M21 has a source terminal thereof connectable to the output terminal 13 via the switchable depletion-mode transistor M23, and gate and drain terminals thereof connected together to the output of the differential amplifier EA11.

In such a configuration, the gain controller 10 controls the gain G of the first differential amplifier EA11 in a manner similar to that depicted in the foregoing embodiments, wherein the switch SW turns on and off an electrical current flow from the output terminal 13 to the source terminal of the diode-connected transistor M21 depending on the differential voltage Vd, so as to enable and disable the diode-connected transistor M21 to electrically connect to, or interfere with, the output VEA1 of the differential amplifier EA11 determining a maximum gate-to-source voltage Vgs applied across the driver transistor M11.

During operation, the depletion-mode transistor M23 turns on and off an electric current therethrough as the differential voltage Vi−Vo applied between the gate and source terminals reaches a threshold voltage Va.

Specifically, where the differential voltage Vd exceeds the threshold voltage Va, the depletion-mode transistor M23 turns off to disable the diode-connected transistor M21 to electrically interfere with the output VEA1 of the differential amplifier EA11.

With the switch SW thus turned off, the first differential amplifier EA11 generates an error-amplified signal VEA1 with a normal, first gain G1.

Contrarily, where the differential voltage Vd falls below the threshold voltage Va, the depletion-mode transistor M23 turns on to enable the diode-connected transistor M21 to electrically interfere with the output VEA1 of the first differential amplifier EA11, that is, to cause an electrical current to flow from the output terminal 13 to the output of the differential amplifier EA11 through the transistors M21 and M23 connected in series.

With the switch SW thus turned on, the first differential amplifier EA11 generates an error-amplified output VEA1 with a reduced, second gain G2 lower than the normal gain G1.

Thus, as is the case with the foregoing embodiments, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the threshold voltage Va, and to the second level G2 lower than the first level G1 where the differential voltage Vd falls below the threshold voltage Va.

Such voltage regulation provided with differential gain control according to the sixth embodiment results in a suppressed overshoot voltage with the power supply input and output voltages Vi and Vo exhibiting similar characteristics as those obtained in the first embodiment depicted in FIGS. 10A and 10B.

Figure 19:
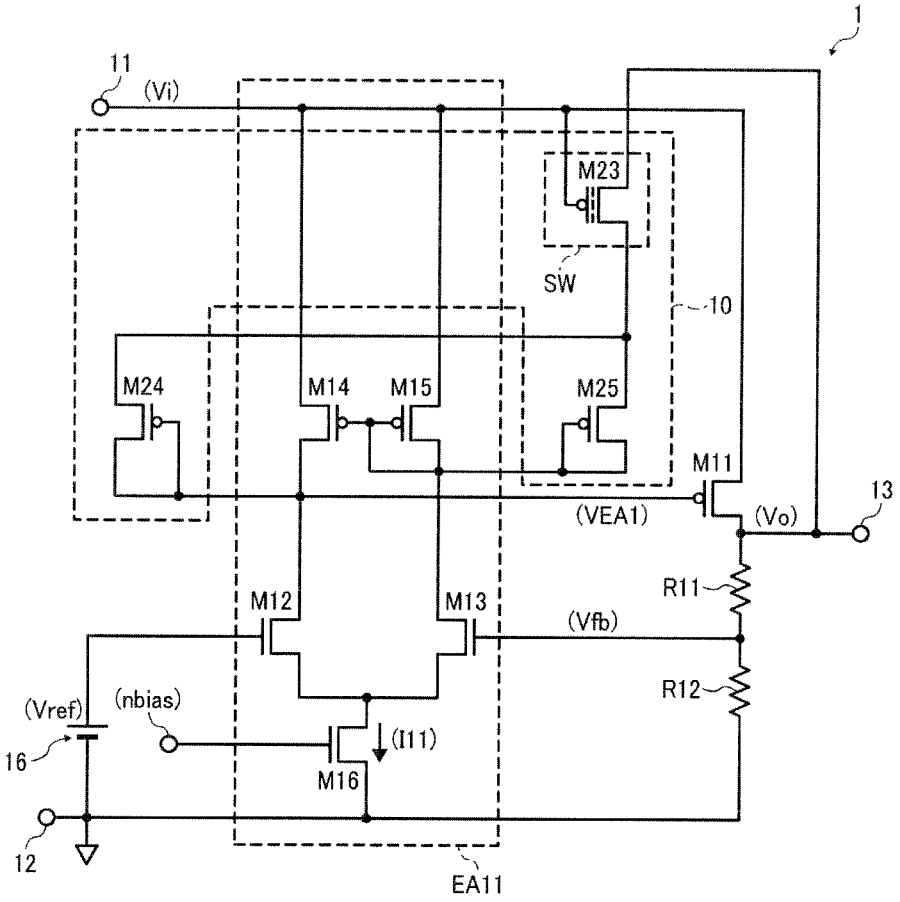
FIG. 19 is a circuit diagram schematically illustrating the constant voltage regulator according to a seventh embodiment of this patent specification.

FIG. 19 is a circuit diagram schematically illustrating the constant voltage regulator 1 according to a seventh embodiment of this patent specification.

As shown in FIG. 19, the overall configuration of the present embodiment is similar to that depicted primarily with reference to FIG. 18, except that the differential gain controller 10 includes a pair of first and second, diode-connected PMOS transistors M24 and M25, instead of a single diode-connected transistor M21, each connected in series with the switch SW.

Specifically, in the present embodiment, the first differential amplifier EA11 has a substantially symmetrical configuration including a differential pair of NMOS transistors M12 and M13, the former having its gate terminal connected to the reference voltage generator 16, and the latter having its gate terminal connected to the feedback node between the voltage divider resistors R11 and R12; a current-mirror active load formed of a pair of PMOS transistors M14 and M15, the former connected in series with one differential transistor M12, and the latter connected in series with the other differential transistor M13, both having their gate terminals connected together to the drain terminal of the transistor M15; and a negatively-biased NMOS transistor M16 having one terminal grounded and another terminal connected to the differential pair to conduct a control current I11 therethrough.

In the differential gain controller 10, the switch SW is disposed between the output terminal 13 and the output of the first differential amplifier EA11, as is the case with the sixth embodiment. The first diode-connected transistor M24 has a source terminal thereof connectable to the output terminal 13 via the switch SW, and gate and drain terminals thereof connected together to the output of the differential amplifier EA11, whereas the second diode-connected transistor M25 has a source terminal thereof connectable to the output terminal 13 via the switch SW, and gate and drain terminals thereof connected together to the drain terminal of the active load transistor M15.

In such a configuration, the gain controller 10 controls the gain G of the first differential amplifier EA11 in a manner similar to that depicted in the foregoing embodiments, wherein the switch SW turns on and off an electrical current flow from the output terminal 13 to the source terminals of the diode-connected transistors M24 and M25 depending on the differential voltage Vd, so as to enable and disable the diode-connected transistors M24 and M25 to electrically connect to, or interfere with, the output VEA1 of the differential amplifier EA11 determining a maximum gate-to-source voltage Vgs applied across the driver transistor M11.

Particularly in the present embodiment, provision of the paired diode-connected transistors M24 and M25 in the differential gain controller 10 allows consistent symmetry and balance between the differential pair of the first differential amplifier EA11, compared to a configuration with a single diode-connected transistor.

With continued reference to FIG. 19, the switch SW of the gain controller 10 is shown including a switchable depletion-mode PMOS transistor M23 connected in series with the first diode-connected transistor M24 between the output terminal 13 and the output of the differential amplifier EA11, and with the second diode-connected transistor M25 between the output terminal 13 and the drain terminal of the active load transistor M15.

In such a configuration, the gain controller 10 controls the gain G of the first differential amplifier EA11 in a manner similar to that depicted in the foregoing embodiments, wherein the switch SW turns on and off an electrical current flow from the output terminal 13 to the source terminals of the diode-connected transistors M24 and M25 depending on the differential voltage Vd, so as to enable and disable the diode-connected transistors M24 and M25 to electrically connect to, or interfere with, the output VEA1 of the differential amplifier EA11 determining a maximum gate-to-source voltage Vgs applied across the driver transistor M11.

During operation, the depletion-mode transistor M23 turns on and off an electric current therethrough as the differential voltage Vi−Vo applied between the gate and source terminals reaches a threshold voltage Va.

Specifically, where the differential voltage Vd exceeds the threshold voltage Va, the depletion-mode transistor M23 turns off to disable the diode-connected transistors M24 and M25 to electrically interfere with the output VEA1 of the differential amplifier EA11.

With the switch SW thus turned off, the first differential amplifier EA11 generates an error-amplified signal VEA1 with a normal, first gain G1.

Contrarily, where the differential voltage Vd falls below the threshold voltage Va, the depletion-mode transistor M23 turns on to enable the diode-connected transistor M24 to electrically interfere with the output VEA1 of the first differential amplifier EA11, that is, to cause an electrical current to flow from the output terminal 13 to the output of the differential amplifier EA11 through the transistors M23 and M24 connected in series.

With the switch SW thus turned on, the first differential amplifier EA11 generates an error-amplified output VEA1 with a reduced, second gain G2 lower than the normal gain G1.

Thus, as is the case with the foregoing embodiments, the differential gain controller 10 switches the differential gain between the first and second levels G1 and G2 depending on the difference Vd between the input and output voltages Vi and Vo, so that the differential gain G is adjusted to the first level G1 where the differential voltage Vd exceeds the threshold voltage Va, and to the second level G2 lower than the first level G1 where the differential voltage Vd falls below the threshold voltage Va.

To recapitulate, the voltage regulator 1 according to this patent specification converts an input voltage Vi input to an input terminal 11 thereof into a regulated, output voltage Vo output to an output terminal 13 thereof, including a driver transistor M11 connected between the input and output terminals 11 and 13 to conduct a current therethrough according to a control signal VEA1 applied to a gate terminal thereof; a feedback voltage generator R11 and R12 connected to the output terminal to generate a feedback voltage Vfb proportional to the output voltage Vo; a reference voltage generator 16 to generate a reference voltage Vref for comparison with the feedback voltage Vfb; a first differential amplifier EA11 having an output thereof connected to the gate terminal of the driver transistor M11, and a pair of differential inputs thereof connected to the feedback voltage generator and the reference voltage generator, respectively, to generate the control signal VEA1 at the output thereof by amplifying a difference between the feedback voltage Vfb and the reference voltage Vref with a variable differential gain G; and a differential gain controller 10 connected to the output of the first differential amplifier EA11 to control the differential gain G according to a difference Vd between the input and output voltages Vi and Vo.

Such voltage regulation according to this patent specification can effectively suppress overshoot voltage as the differential gain controller 10 provides the differential amplifier EA11 with an appropriate differential gain according to the differential voltage Vd between the input and output voltages Vi and Vo. In particular, provision of the differential gain controller 10 effectively protects the output voltage Vo against significant voltage overshoot in low-power consumption applications even where the power supply voltage upon power-on increases with a relatively large time constant larger than which is determined by the driver transistor's ON resistance and load current, as well as capacitance connected to the output terminal of the voltage regulator, thereby allowing for implementation of the voltage regulator 1 in electronic circuitry that operates with an extremely low current consumed therethrough.

In one embodiment of this patent specification, the differential gain controller 10 exhibits a threshold voltage Va for switching the differential gain G between a first gain G1 and a second gain G2 lower than the first gain G1, wherein the differential gain G is switched to the first gain G1 where the difference Vd between the input and output voltages Vi and Vo exceeds the threshold voltage Va, and to the second gain G2 where the difference Vd between the input and output voltages Vi and Vo falls below the threshold voltage Va.

For example, the differential gain controller 10 can readily switch the differential gain G by adjusting a maximum gate-to-source voltage Vgs across the driver transistor M11 between a first level and a second level lower than the first level, wherein the maximum gate-to-source voltage Vgs is adjusted to the first level where the difference Vd between the input and output voltages Vi and Vo exceeds the threshold voltage Va, and to the second level where the difference Vd between the input and output voltages Vi and Vo falls below the threshold voltage Va.

In further embodiment, the differential gain controller 10 can readily switch the differential gain G without consuming excessive current by including a switch SW disposed between a given terminal of the voltage regulator 1 and the output of the first differential amplifier EA11; and a diode-connected transistor M21 having a source terminal connectable to the given terminal via the switch SW, and gate and drain terminals thereof connected together to the output of the differential amplifier EA11, wherein the switch SW connects the source terminal of the diode-connected transistor M21 to the given terminal depending on the difference Vd between the input and output voltages Vi and Vo, so as to enable and disable the diode-connected transistor M21 to electrically interfere with the output of the differential amplifier EA11.

For example, where the driver transistor M11 and the diode-connected transistor M21 are each configured as a p-channel metal-oxide semiconductor transistor, the switch SW may connect the source terminal of the diode-connected transistor M21 to the input terminal Vi of the voltage regulator 1 depending on the difference Vd between the input and output voltages Vi and Vo.

Alternatively, where the driver transistor M11 and the diode-connected transistor M21 are each configured as a p-channel metal-oxide semiconductor transistor, the switch SW may connect the source terminal of the diode-connected transistor M21 to the output terminal Vo of the voltage regulator 1 depending on the difference Vd between the input and output voltages Vi and Vo.

Still alternatively, where the driver transistor M11 and the diode-connected transistor M21 are each configured as an n-channel metal-oxide semiconductor transistor, the switch SW may connect the source terminal of the diode-connected transistor M21 to a ground terminal 12 of the voltage regulator 1 depending on the difference Vd between the input and output voltages Vi and Vo.

Such voltage regulator 1 may find application in power supply circuitry of various electronic devices, such as personal computers and cellular phones, particularly those implemented in a low-current consumption integrated circuit (IC).

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application No. 2010-158883 filed on Jul. 13, 2010 in the Japanese Patent Office, the entire contents of which are hereby incorporated by reference herein.

What is claimed is:

1. A voltage regulator that converts an input voltage input to an input terminal thereof into a regulated, output voltage output to an output terminal thereof, the voltage regulator comprising:

a driver transistor connected between the input and output terminals to conduct a current therethrough according to a control signal applied to a gate terminal thereof;

a feedback voltage generator connected to the output terminal to generate a feedback voltage proportional to the output voltage;

a reference voltage generator to generate a reference voltage for comparison with the feedback voltage;

a first differential amplifier having an output thereof connected to the gate terminal of the driver transistor, and a pair of differential inputs thereof connected to the feedback voltage generator and the reference voltage generator, respectively, to generate the control signal at the output thereof by amplifying a difference between the feedback voltage and the reference voltage with a variable differential gain; and a differential gain controller connected to the output of the first differential amplifier to control the differential gain according to a difference between the input and output voltages.

2. The voltage regulator according to claim 1, wherein the differential gain controller exhibits a threshold voltage for switching the differential gain between a first gain and a second gain lower than the first gain, the differential gain being switched to the first gain where the difference between the input and output voltages exceeds the threshold voltage, and to the second gain where the difference between the input and output voltages falls below the threshold voltage.

3. The voltage regulator according to claim 2, wherein the differential gain controller switches the differential gain by adjusting a maximum gate-to-source voltage across the driver transistor between a first level and a second level lower than the first level, the maximum gate-to-source voltage being adjusted to the first level where the difference between the input and output voltages exceeds the threshold voltage, and to the second level where the difference between the input and output voltages falls below the threshold voltage.

4. The voltage regulator according to claim 1, wherein the differential gain controller includes:

a switch disposed between a given terminal of the voltage regulator and the output of the first differential amplifier; and a diode-connected transistor having a source terminal connectable to the given terminal via the switch, and gate and drain terminals thereof connected together to the output of the differential amplifier, the switch connecting the source terminal of the diode-connected transistor to the given terminal depending on the difference between the input and output voltages, so as to enable and disable the diode-connected transistor to electrically interfere with the output of the differential amplifier.

5. The voltage regulator according to claim 4, wherein the driver transistor and the diode-connected transistor are p-channel metal-oxide semiconductor transistors, and the switch connecting the source terminal of the diode-connected transistor to the input terminal of the voltage regulator depending on the difference between the input and output voltages.

6. The voltage regulator according to claim 4, wherein the driver transistor and the diode-connected transistor are p-channel metal-oxide semiconductor transistors, and the switch connecting the source terminal of the diode-connected transistor to the output terminal of the voltage regulator depending on the difference between the input and output voltages.

7. The voltage regulator according to claim 4, wherein the driver transistor and the diode-connected transistor are n-channel metal-oxide semiconductor transistors, and the switch connecting the source terminal of the diode-connected transistor to a ground terminal of the voltage regulator depending on the difference between the input and output voltages.

8. The voltage regulator according to claim 4, wherein the switch of the gain controller includes:

a switchable transistor connected in series with the diode-connected transistor between the given terminal of the voltage regulator and the output of the first differential amplifier; and a second differential amplifier having an output thereof connected to a gate terminal of the switchable transistor, and a pair of differential inputs thereof connected to the input and output terminals, respectively, to cause the switchable transistor to turn on and off depending on the difference between the input and output voltages, the second differential amplifier exhibiting an offset voltage so as to turn off the switchable transistor where the difference between the input and output voltages exceeds the offset voltage, and turn on the switchable transistor where the difference between the input and output voltages falls below the offset voltage.

9. The voltage regulator according to claim 4, wherein the switch of the gain controller includes:

a switchable, depletion-mode transistor having a gate terminal thereof connected to the input terminal and a source terminal thereof connected to the output terminal, the depletion-mode transistor exhibiting a threshold voltage so as to turn off where the difference between the input and output voltages exceeds the threshold voltage, and turn on where the difference between the input and output voltages falls below the threshold voltage.

10. The voltage regulator according to claim 1, wherein the differential gain controller includes:

a switch disposed between a given terminal of the voltage regulator and the output of the first differential amplifier; and a first diode-connected transistor having a source terminal thereof connectable to the given terminal via the switch, and gate and drain terminals thereof connected together to the output of the first differential amplifier; and a second diode-connected transistor having a source terminal thereof connectable to the given terminal via the switch, and gate and drain terminals thereof connected together to a drain terminal of an active load of the first differential amplifier the switch connecting the source terminals of the diode-connected transistors to the given terminal depending on the difference between the input and output voltages, so as to enable and disable the diode-connected transistors to electrically interfere with the output of the differential amplifier.

11. An electronic device incorporating the voltage regulator according to claim 1.

* * * * *